US005361562A

United States Patent [19]

Nagaoka et al.

[11] Patent Number: 5,361,562

[45] Date of Patent: Nov. 8, 1994

[54] METHOD AND APPARATUS FOR OPENING LID OF BOX

[75] Inventors: Hitoshi Nagaoka, Chiba; Hiroyuki Shimizu; Keizo Nakashima, both of Kanagawa, all of Japan

[73] Assignee: Niigata Engineering Co., Ltd., Tokyo, Japan

[21] Appl. No.: 994,294

[22] Filed: Dec. 21, 1992

[30] Foreign Application Priority Data

Feb. 13, 1992 [JP] Japan ..... 4-026402
Sep. 17, 1992 [JP] Japan ..... 4-248073

[51] Int. Cl.[5] ..... B65B 43/40; B65B 69/00

[52] U.S. Cl. ..... 53/492; 53/381.4; 414/411

[58] Field of Search ..... 53/492, 381.4, 382.2; 414/411, 412, 676

[56] References Cited

U.S. PATENT DOCUMENTS 2,918,773 12/1959 Krupp et al. ..... 53/382.2 X
2,940,229 6/1960 Baker ..... 53/492
2,995,883 8/1961 Aubry et al. ..... 53/381.4
3,247,646 4/1966 McIntyre ..... 53/382.2 X
3,513,621 8/1967 Chamberlin ..... 53/381.4 X
3,777,455 12/1973 Allen .
3,845,605 11/1974 Hartness ..... 53/381.4 X
4,466,767 8/1984 Meschi ..... 53/381.4 X
4,692,083 9/1987 LeRoux et al. ..... 414/411
5,059,082 10/1991 Tanttu et al. ..... 53/492 X

*Primary Examiner*—Horace M. Culver
*Attorney, Agent, or Firm*—Sughrue, Mion, Zinn, Macpeak & Seas

[57] ABSTRACT

The lid of a box is pushed up from the main body of the box by injecting gas by use of one or more injection nozzles into a gap formed between the lid and main body of the box and then, with part of a top plate of the lid in contact with a lid rotating stopper, gas is further injected into the gap, or the lid is pushed up by injecting gas into the gap by use of one or more lower position injection nozzles and then gas is injected into the gap by use of one or more higher position injection nozzles in one or more stages, before the lid is opened from the main body. Thereby, it is possible to prevent the lids from being opened in a three-dimensional inclined state (in a one-side opened state) as well as to prevent the lid and main body of a box from being pushed upwardly simultaneously.

14 Claims, 16 Drawing Sheets

METHOD AND APPARATUS FOR OPENING LID OF BOX

BACKGROUND OF THE INVENTION

The present invention relates to a method of opening a lid of a box including a main body and a lid which is freely openable and closable with respect to the main body, and the device for the same method.

In general, as means for packing goods, a box is used and, in a factory, goods such as a large quantity of foods or the like are packed in a given packing line. In such packing line, a box for packing the foods is supplied with its lid closed condition and, in particular, in the packing line of the factory, it is demanded that the lids of the boxes are opened from the main bodies of the boxes automatically, in a large quantity and at a high speed.

For example, in FIG. 30, reference numeral 1 designates for a box. The box 1 includes a box main body 2 formed of cardboard and having an opening 2A in one of the side portions thereof, and a lid 3 formed of cardboard and having vertical portions 3A, the lid 3 being adapted to be put over the opening 2A of the box main body. The vertical portions 3A of the lid 3 are superimposed on the peripheries of the side surface portions 2B of the main body 2 respectively so that the lid 3 can be opened and closed freely. And, the box main body 2 is formed to be strong because it is used to pack bottles or the like. On the surface of the lid 3, there are printed the name of the manufacturer, the name of the goods, a decorative design and the like. As compared with the box main body 2, the lid 3 is smaller in thickness and the vertical porions 3A of the lid 3 are relatively flexible.

However, in the conventional method, when the lids of boxes supplied successively on a packing line are opened from the main bodies of the boxes, the lids opening operation is executed manually by an operator manual and, therefore, it is difficult to open a large quantity of the lids of the boxes in a short time.

In FIGS. 31 to 33, there is shown an embodiment of a method for opening the lid 3 of the above-mentioned box 1 by hand.

As shown in FIG. 31, if an operator grasps the vertical portions 3A of the lid 3 of the box 1 by both hands and lifts up the whole box 1, then the box main body 2 will slip down to some extent due to its own weight and thus will take a position as shown by dotted chained lines. And, as shown in FIG. 32, with the main body 2 in such position, while holding the main body 2 with one hand 4, the operator grasps the lid 3 with the other hand 4 and then removes the lid 3 upwardly from the main body 2. When one of the vertical portions 3A of the lid 3 is removed from the main body 2, then the lid 3 is inclined in a state as shown in FIG. 33.

In view of this, as means for automating the opening of the lids of the boxes, there is also known a method in which the lid of the box is opened from the main body of the box by suction applied to the top plate of the lid by suction pads. According to the lid opening method by use of the suction pads, for example, as shown in FIGS. 36 and 37, the four corner portions of a lower surface 102A of a main body 102 of a box 101 are respectively sucked by main body suction pads 105 (only two of them are shown) and, the four corner portions of an upper surface 103B of a lid 103 of the box 101 are respectively sucked by lid suction pads 106. Next, if the main body suction pads 105 are pulled downwardly and at the same time the lid suction pads 106 are pulled upwardly, then the lid 103 can be separated from the main body 102.

However, in the former example in which the lid is opened manually by the operator, it is necessary for the operator to grasp the lid 3 by hands 4 and to wait for the box main body 2 to slip down to some extent due to its own weight before the lid 3 can be opened completely. This requires a long time to open the lid 3.

Alternatively, in the later example of the lid opening method by use of the suction pads 105 and 106, when trying to separate the lid 103 and main body 102 from each other, the vertical portions 103A of the lid 103 are flexed inwardly or in an inwardly caving manner to closely contact the side surface portions 102B of the main body 102, which makes it difficult for air to flow into the box 101. As a result of this, the internal pressure of the box 101 is decreased to thereby cause the box 1 to be pushed inwardly by the external pressure thereof, which makes it difficult for the lid 103 to be opened and thus extends a time necessary to open the lid 103.

Also, when trying to open the lid 103 quickly, the upper surface 103B of the lid 103 is flexed to a great extent to thereby leave wrinkles and the traces of the suction pads on the four corners of the upper surface 103B of the lid 103.

SUMMARY OF THE INVENTION

The present invention is to eliminate the drawbacks found in the above-mentioned conventional art. Accordingly, it is an object of the invention to provide a method and apparatus for opening the lid of a box, which makes it easy to open the lid, reduces the time required to open the lid, and prevents the surface of the lid from being damaged.

In order to achieve the above object, according to first aspect of the invention, there is provided a method and apparatus for opening the lid of a box in which the vertical portions of the freely openable and closable lid are superimposed on the peripheries of the side surface portions of the main body having an opening in one of the side portions thereof, characterized in that air or gas is blown into the box from a gap formed between the inner surfaces of the vertical portions of the lid and the outer surfaces of the main body.

According to the first aspect of the invention, if air or gas is blown into the box from a gap formed between the inner surfaces of the vertical portions of the lid and the outer surfaces of the main body, then the internal pressure of the box is increased to become higher than the external pressure thereof. The increased internal pressure produces a force from inside of the box tending to open the lid or main body, so that the main body and lid can be separated from each other.

In the case where air is blown into the box from a gap formed between the inner side surface of the vertical portion of the lid of the box and the outer side surface of the main body of the box, the lid of the box can be separated from the main body of the box. However, in this case, due to the fact that the inner side surface of the vertical portion of the box lid is in close touch with the outer side surface of the box main body by means of a frictional force, if the pressure of the air is too high, then the lid and main body of the box are pushed up at the same time when the air is injected. This means that it is still difficult to separate the lid and main body from each other. On the other hand, if the pressure of the air is decreased too much, then the lid cannot be raised up.

Also, for example, in a case where the lid of a box is automatically separated from the main body of the box, when separating a lid from one of boxes successively supplied on a packing line, if an operation to inject air from the above-mentioned gap is to be executed, then most of the air is supplied to one side portion of the gap, so that the lid is not opened in a direction perpendicular to the flow direction of the packing line, but, as shown in FIGS. 34 and 35, the lid is opened in a state of three-dimensional inclination (one side opened) in which a corner 201A of the lid 201 is pushed up and a corner 201C on the diagonal line of a corner 201A of a top plate 201B is positioned lowest. And, the lid is opened at one side thereof as described above and, therefore, the lids opened are not of the same attitude. For example, when the boxes are supplied successively with a narrow pitch, the lids opened from the associated main bodies may collide with each other to cause the opened states of the lids to be inconsistent. This makes it difficult for the lids to be separated automatically from the main bodies in the following step of the opening process and requires an operator to manually correct the position of the lids.

The present invention also eliminates these drawbacks. Accordingly, it is an object of the invention to provide a method of opening the lid of a box in which the lids of boxes are respectively opened from the main bodies of the boxes in the same attitude to prevent the three-dimension inclination (one side opened) and at the same time the lid and main body of the box are prevented from being pushed up simultaneously, and a device for executing the same method.

According to second aspect of the invention, there is provided a method of opening a lid from a box which can be freely opened and closed and is constructed such that the vertical portions of the lid are superimposed on the peripheries of the side surface portions of a main body of the box, the method comprising the steps of: injecting gas into a gap formed between the inner side surface of the vertical portion of the lid of the box and the outer side surface of the main body of the box by means of an injection nozzle disposed by the side of the main body to thereby push up the lid from the main body to a height where the lower end opening of the lid is not separated from the upper end opening of the main body; and, further injecting the gas into gap while part of the top plate of the lid is in contact with a lid rotating stopper disposed at a position spaced upwardly a given distance from the lid and shifted in the opposite direction to the injection nozzle.

According to third aspect of the invention, there is provided a device for opening a lid from a box which can be freely opened and closed and is constructed such that the vertical portions of the lid are superimposed on the peripheries of the side surface portions of a main body of the box, the device comprising: one or more injection nozzles disposed by the side of the main body for injecting gas into a gap formed between the inner side surface of the vertical portion of the lid of the box and the outer side surface of the main body; and, a lid rotating stopper disposed at a position spaced a given distance upwardly from said lid and shifted in the opposite direction to the injection nozzles, the stopper being contacted by part of the lid at a height where the lower end opening of the lid is not separated from the upper end opening of the main body.

According to the fourth aspect of the invention, there is provided a method of opening a lid from a box which can be freely opened and closed and is constructed such that the vertical portions of the lid are superimposed on the peripheries of the side surface portions of the main body, the method including the steps of: injecting gas into a gap formed between the inner side surface of the vertical portion of the lid and the outer side surface of the main body means of one or more lower position injection nozzles disposed by the side of the main body to thereby push up the lid from the main body to a height where the lower end opening of the lid is not separated from the upper end opening of the main body; and, injecting gas into the gap by means of one or more higher position injection nozzles in one more stages disposed at a position higher a given height from the lower position injection nozzles to thereby open the lid from the main body.

According to the fifth aspect of the inventions there is provided a device for opening a lid from a box which can be freely opened and closed and is constructed such that the vertical portions of the lid are superimposed on the peripheries of the side surface portions of the main body, the device comprising: one or more lower position injection nozzles for injecting gas into a gap formed between the inner side surface of the vertical portion of the lid of the box and the outer side surface of the main body to thereby push up the lid to a height where the lower end opening of the lid is not separated from the upper end opening of the main body; and, one or more higher position injection nozzles in one or more stages disposed at a position higher a given height than the lower position injection nozzles.

According to the second and third aspects of the invention, for example, if gas is blown in from a gap formed in a box when lids are opened from their associated boxes which are being conveyed successively, then most of the gas is supplied to one side portion of the gap, with the result that the lid cannot be opened in a direction perpendicular to the box conveyance direction but the lid is going to be opened with a corner of the lid being raised up, that is to say, in a state of three-dimensions inclination (one side opening state). However, with part of the top plate of the lid in contact with the lid rotating stopper, if the gas is further blown in from the gap to thereby push up the portions of the top plate of the lid not in contact with the lid rotating stopper until the portions are brought into contact with the lid rotating stopper, then the inclined attitude of the lid can be controlled to a state of two-dimension inclination so that the lid can be opened from the main body.

According to the fourth and fifth aspects of the invention, if gas is injected into a box through a gap formed between the inner side surface of the vertical portion of a lid of the box and the outer side surface of a main body of the box by means of one or more lower position injection nozzles, then the internal pressure of the box is increased to become higher than the external pressure of the box. The increased internal pressure gives a force to the box from inside to open the lid or main body of the box.

At that time, the lid is pushed up by the lower position injection nozzles from the main body to a height where the lower end opening of the lid is not separated from the upper end opening of the main body. In this case, as the lid is pushed up, the force to push up the lid by the lower position injection nozzle is decreased and there comes a time when gravity is going to exceed the pushing-up force and thus the lid is going to move down. Then, if gas is injected from one or more higher position injection nozzles in one or more stages disposed upwardly of the lower position injection nozzles, then one side of the lid going to move down is raised up to thereby be able to open the lid from the main body. In other words, the lid is inclined in such a manner that one side of the lower end opening of the lid is pushed up onto the upper end opening of the box main body while the other side thereof is lowered down on the middle portion of the outer side surface of the main body or is supported on the support surface of the main body.

DETAILED DESCRIPTION OF PREFERRED EMBODIMENTS

Figure 1:
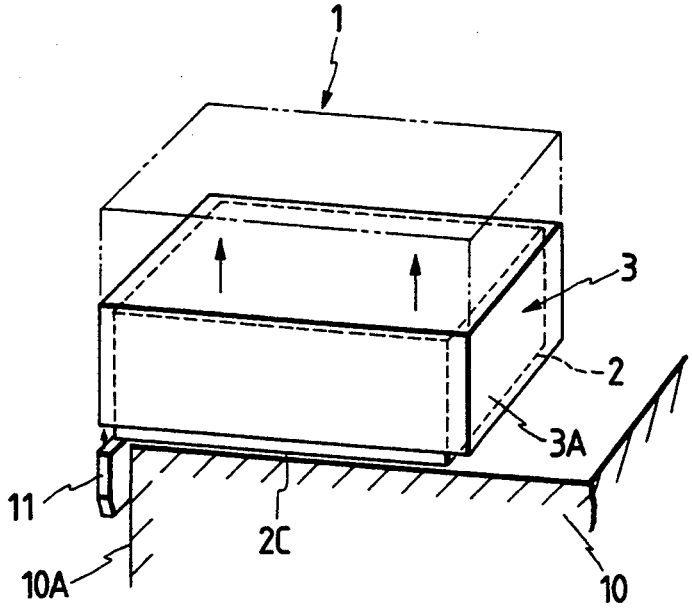
FIG. 1 is a perspective view of a front half process of a first embodiment of a method of separating the lid and main body of a box according to the invention.
Figure 2:
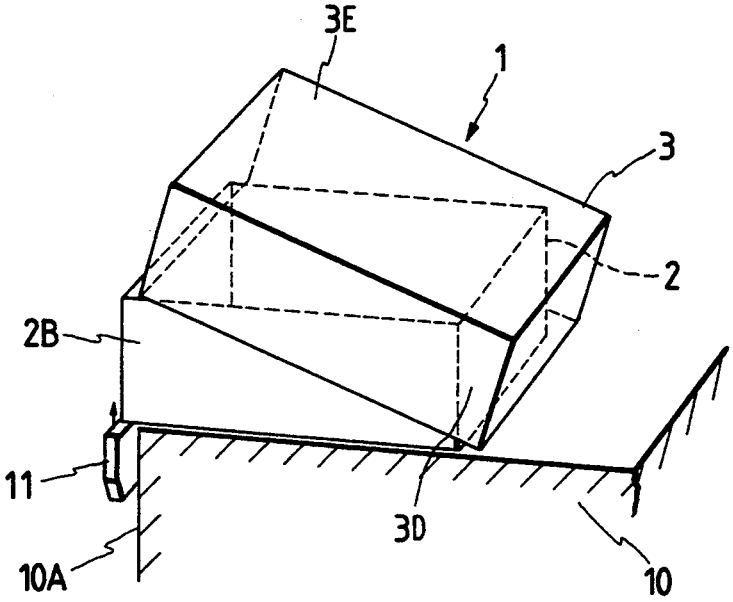
FIG. 2 is a perspective view of a rear half process of the first embodiment of a method of separating the lid and main body of a box according to the invention.
Figure 3:
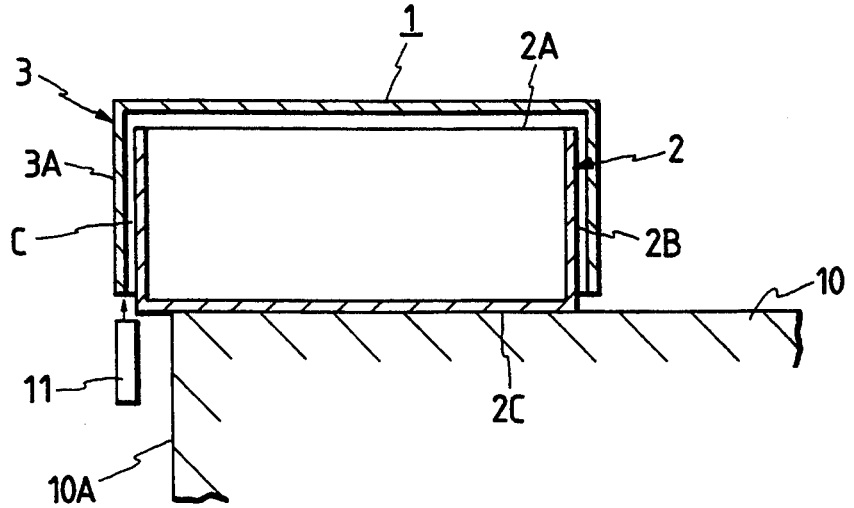
FIG. 3 is a section view of the box in the first embodiment according to the invention.

Description will be given hereinbelow of a first embodiment of a method of separating the lid and main body of a box according to the invention with reference to FIGS. 1 to 3.

Figure 30:
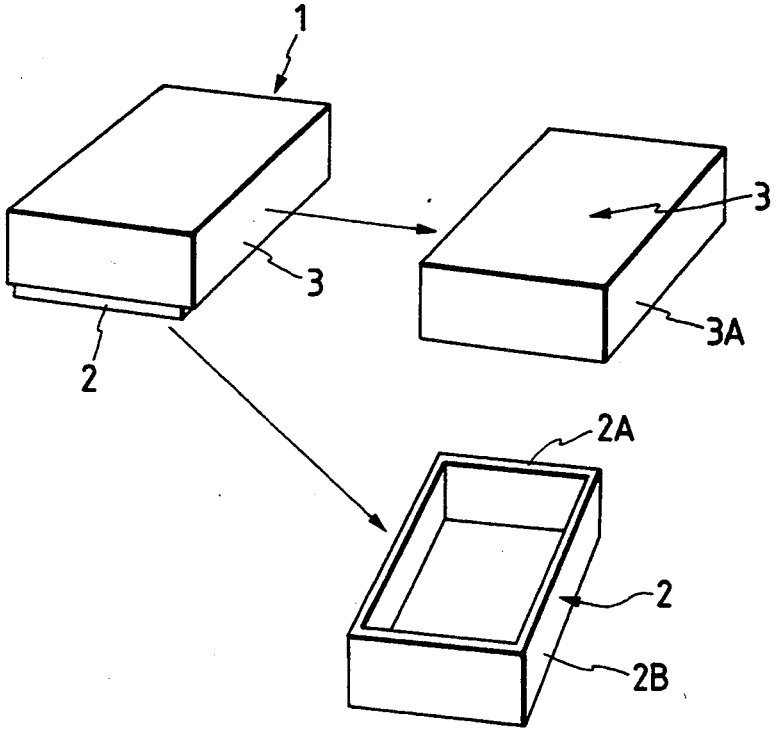
FIG. 30 is an exploded perspective view of the box.
Figure 31:
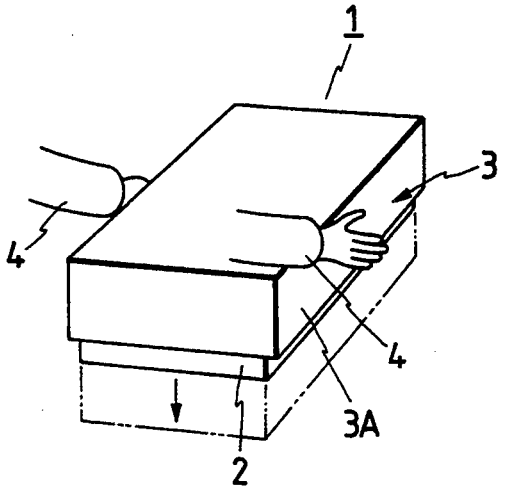
FIG. 31 is a perspective view of a first step in a first embodiment of a method of separating the lid and main body of a box according to the prior art.
Figure 32:
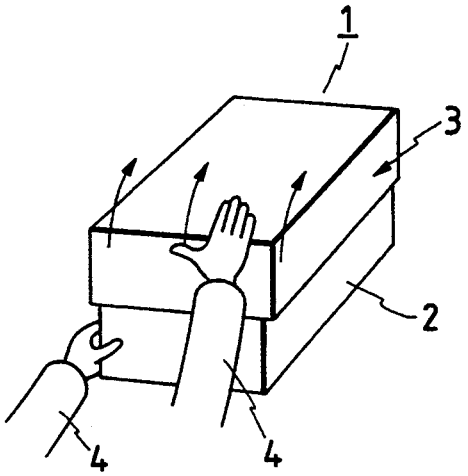
FIG. 32 is a perspective view of a second step in the second embodiment of the prior art separating method.
Figure 33:
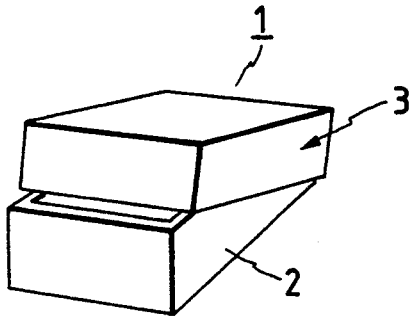
FIG. 33 is a perspective view of a third step in the first embodiment of the prior art separating method.
Figure 34:
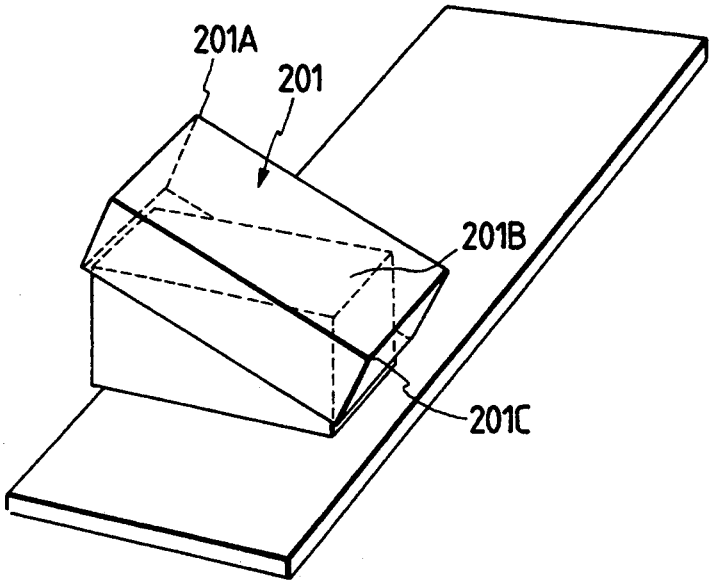
FIG. 34 is a perspective view of the box, showing a state in which the lid is opened in a three-dimensional inclined position (in a one-side opened position)
Figure 35:
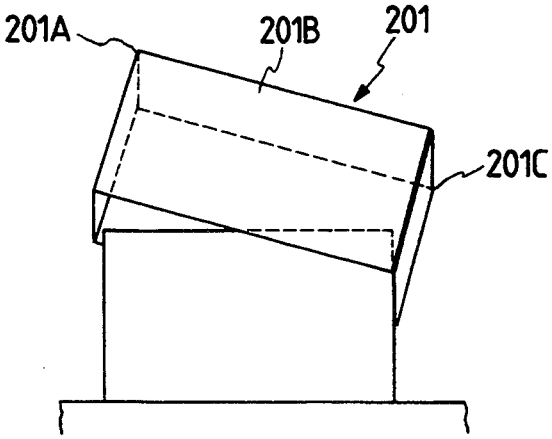
FIG. 35 is a perspective view of the box, showing a state in which the lid is opened in a three-dimensional inclined position (in a one-side opened position)
Figure 36:
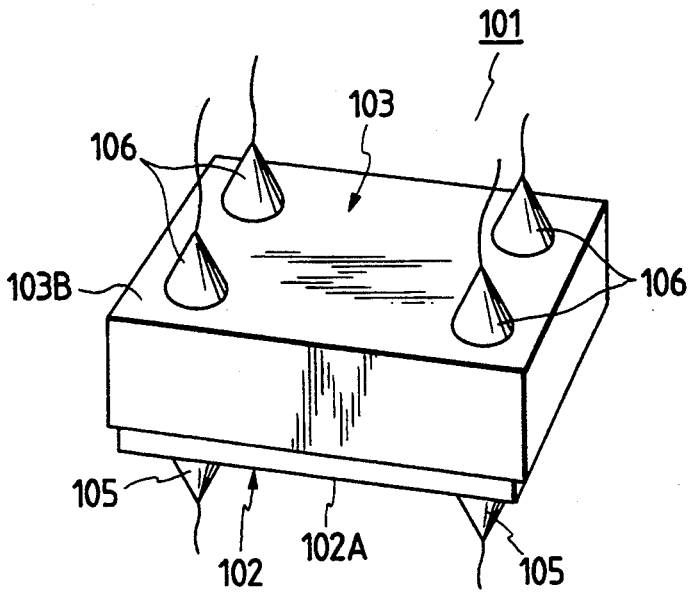
FIG. 36 is a perspective view of a box, showing a first step for opening the lid of the box according to the prior art.
Figure 37:
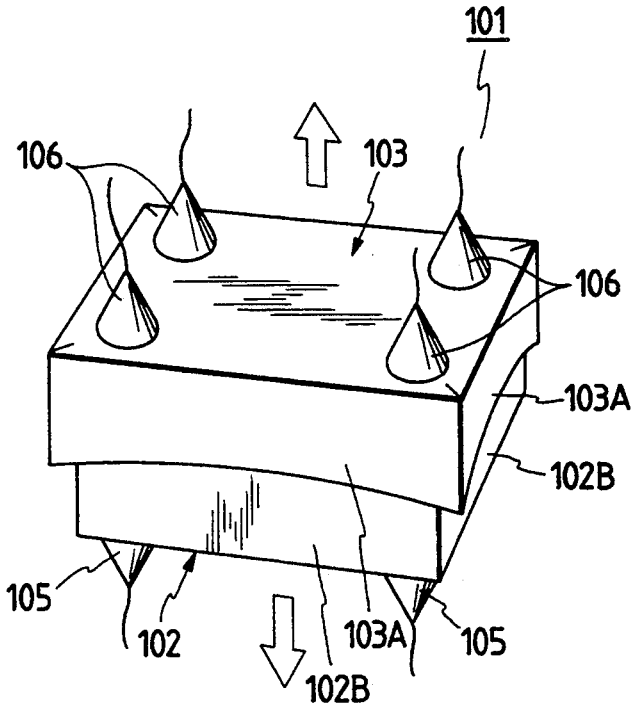
FIG. 37 is a perspective view of the box, showing a second step for opening the lid of the box according to the prior art.

The first embodiment of the invention will be described by way of the box 1 which was described before with reference to FIG. 30. The box 1 has a section which is shown in FIG. 3, and it includes a main body 2 having an opening 2A in one of the side portions thereof and a lid 3 to be placed over the opening 2A of the main body 2. The lid 3 includes vertical portions 3A. There is formed a gap C interposed between the inner side surfaces of the vertical portions 3A of the lid 3 and the outer surfaces of the side surface portions 2B of the main body 2.

The box 1 is put on a support table 10 in such a manner that the lid 3 is disposed over the box 1 and the bottom surface 2C of the main body 2 is in contact with the top surface of the support table 10, and further the box 1 projects in part from the end face 10A of the support table 10. Also, there is provided an air blow device below the gap C. The air blow device 11 is composed of a plurality of nozzles arranged in a straight line, and is connected through a hose or the like to a source of compressed air such as a compressor or the like.

When air is blown from the air blow device 11 through the gap C in the box 1 into the box 1, then the internal pressure of the box 1 is increased to become higher than the external pressure thereof. The increased internal pressure produces a force to open the lid 3 from inside the box 1. Due to this, the lid 3 is caused to move from a state shown in FIG. 1 to a state shown in FIG. 2: that is, with one side 3D of the lid 3 supported on the support table 10, the other side 3E of the lid 3 is pushed up along the side surface portion 2B of the main body 2, is then removed from the main body 2, and is further moved on to the upper end of the side surface portion 2B of the main body 2. In this manner, the lid 3 is moved on to the main body 2 in an inclined manner and thus the lid 3 can be opened from main body 2.

According to the above-mentioned structure, the lid 3 can be opened from the main body 2 by blowing air through the gap C into the box 1 and, therefore, there is eliminated the need for an operation to grasp the lid 3 when the lid 3 is to be opened. That is, the first embodiment of the invention makes it quite easy to open the lid 3, and eliminates a preparation time for opening the lid 3, so that a time necessary to open the lid 3 can be reduced as a whole.

Also, when compared with the conventional methods in which, when opening the lid 3, the lid opening and closing means such as human hands, suction pads or the like are placed in direct contact with the outer surfaces of the lid 3, according to the first embodiment of the invention, since the internal pressure acts uniformly on the box 1 from inside, there is not required any means which may be in contact with the outer surfaces of the lid 3, thereby preventing the outer surface of the lid 3 from being stained or damaged.

Figure 4:
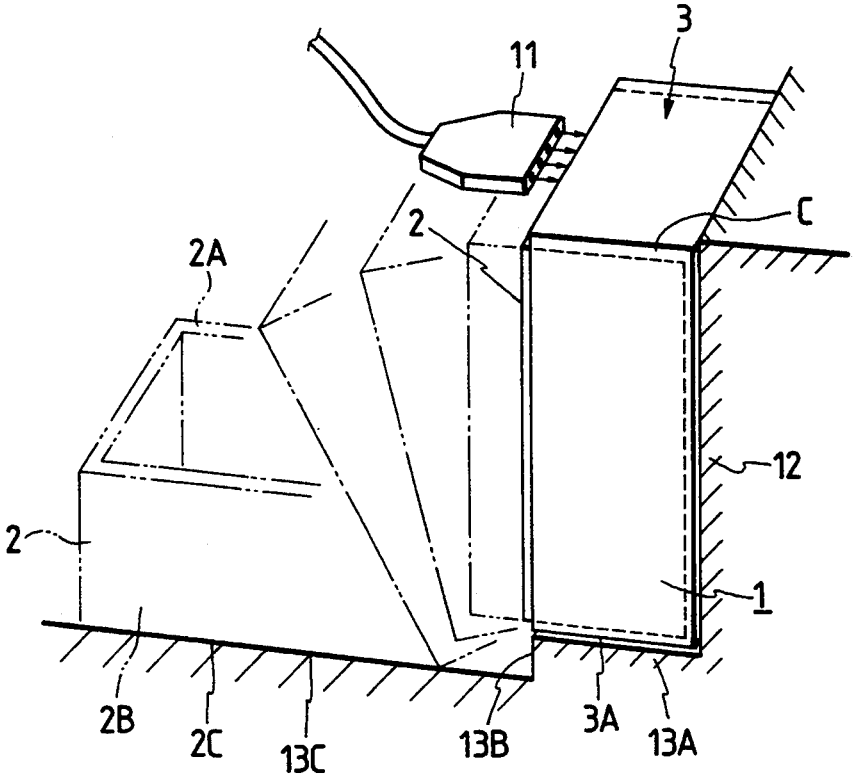
FIG. 4 is a perspective view of a second embodiment of a method of separating the lid and main body of a box according to the invention.

Next, description will be given below of a second embodiment of a method of separating the lid and main body of a box according to the invention with reference to FIG. 4. In the second embodiment, similar to the first embodiment, description will be given by way of the box 1 shown in FIG. 30. The box 1 employed in the second embodiment is similar in structure to that in the first embodiment and thus description thereof is omitted here.

The box 1 is disposed in such a manner that, with the lid 3 pressed against a wall surface 12, the vertical portion 3A of the lid 3 is put on an upper step portion 13A and by the side of the gap C there is provided an air blow device 11. The air blow device 11 is composed of a plurality of nozzles which are arranged in a straight line. And, a lower step portion 13C is connected through a stepped portion 13B to the upper step portion 13A.

When air is blown from the air blow device through the gap C in the box 1 into the box 1, then the internal pressure of the box 1 is increased to become higher than the external pressure of the box 1. The increased internal pressure acts produces a force to open the main body 2 from inside the box 1. Due to this, with the lid 3 pressed against the wall surface 12, the main body 2 is pushed out in a direction where it is separated from the wall surface 12, so that the main body 2 is caused to drop down along the stepped portion 13B and the lower end of the side surface portion 2B of the main body 2 is supported on the lower step portion 13C. Further, in this state, the main body 2 is rotated so that, with the opening 2A thereof facing upwardly, the bottom surface 2C of the main body 2 is put on the lower step portion 13C and thus the main body 2 can be opened from the lid 3 which is pressed against the wall surface 12.

In this manner, the main body 2 and lid 3 can be separated from each other and a similar effect as in the first embodiment can be provided.

Here, it should be noted that, although in the above-mentioned embodiments air is used other gases may be used, for example, carbon dioxide gas may be used.

As has been described hereinbefore, according to the invention, due to the fact that the main body and lid of a box can be separated from each other by blowing gas into the box, unlike the conventional methods, in opening the lid, there is eliminated the need for an operation to grasp the lid to thereby facilitate the opening operation of the main body and lid of the box, so that a time required for opening of the lid can be reduced accordingly.

Also, when compared with the conventional methods in which, in opening the lid, the lid opening and closing means such as human hands, suction pads or the like are brought into direct contact with the outer surface of the lid, according to the invention, since the internal pressure acts uniformly on the lid and main body of the box from inside, there is no direct contact with the outer surface of the lid, thereby preventing the outer surface of the lid from being stained or damaged.

Description will be hereinbelow given of the other embodiments of a method of opening the lid of a box and a device for enforcing the same method according to the invention with reference to FIGS. 5 to 21, and FIGS. 28 and 29.

Figure 28:
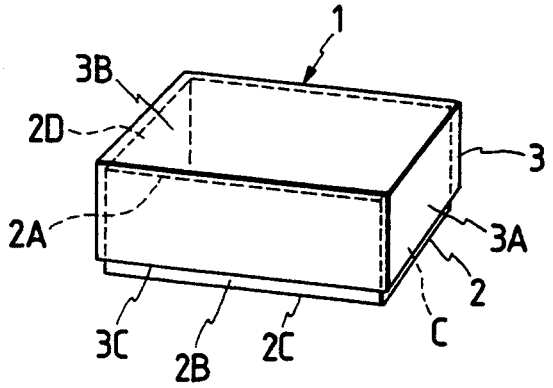
FIG. 28 is a perspective view of the box, showing how the box is assembled.
Figure 29:
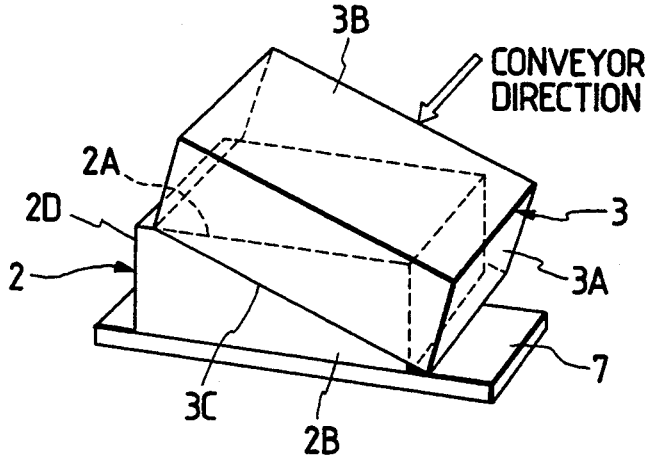
FIG. 29 is a perspective view of the box, showing the opened state of the box.

Firstly, description will be given by way of a box 1 which is shown in FIGS. 28 and 29. The box 1 comprises a main body 2 having an upper end opening formed in the upper end portion thereof and a lid 3 having vertical portions 3A to be superimposed on the upper end opening 2A of the main body 2. There is formed a gap C between the inner side surface of the vertical portion 3A of the lid and the outer surface of the side surface portion 2B of the main body 2.

A lid opening device according to the present embodiment of the invention is adapted such that, by injecting air into the gap C while conveying the box 1, it turns the box 1 from a lid closed state shown in FIG. 28 to a lid opened state shown in FIG. 29.

Figure 5:
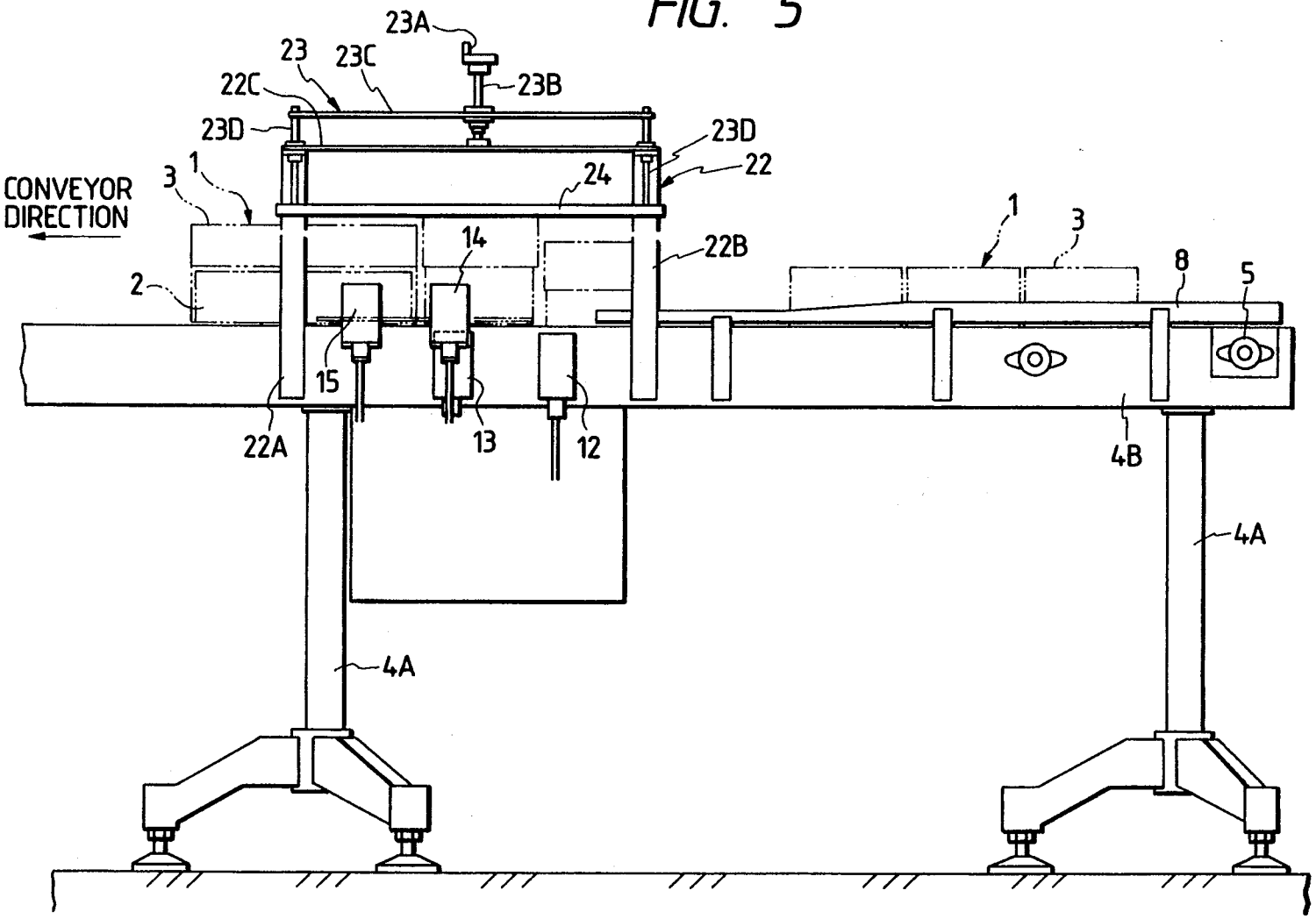
FIG. 5 is a side view of a first embodiment of the whole box lid opening device according to the invention.
Figure 6:
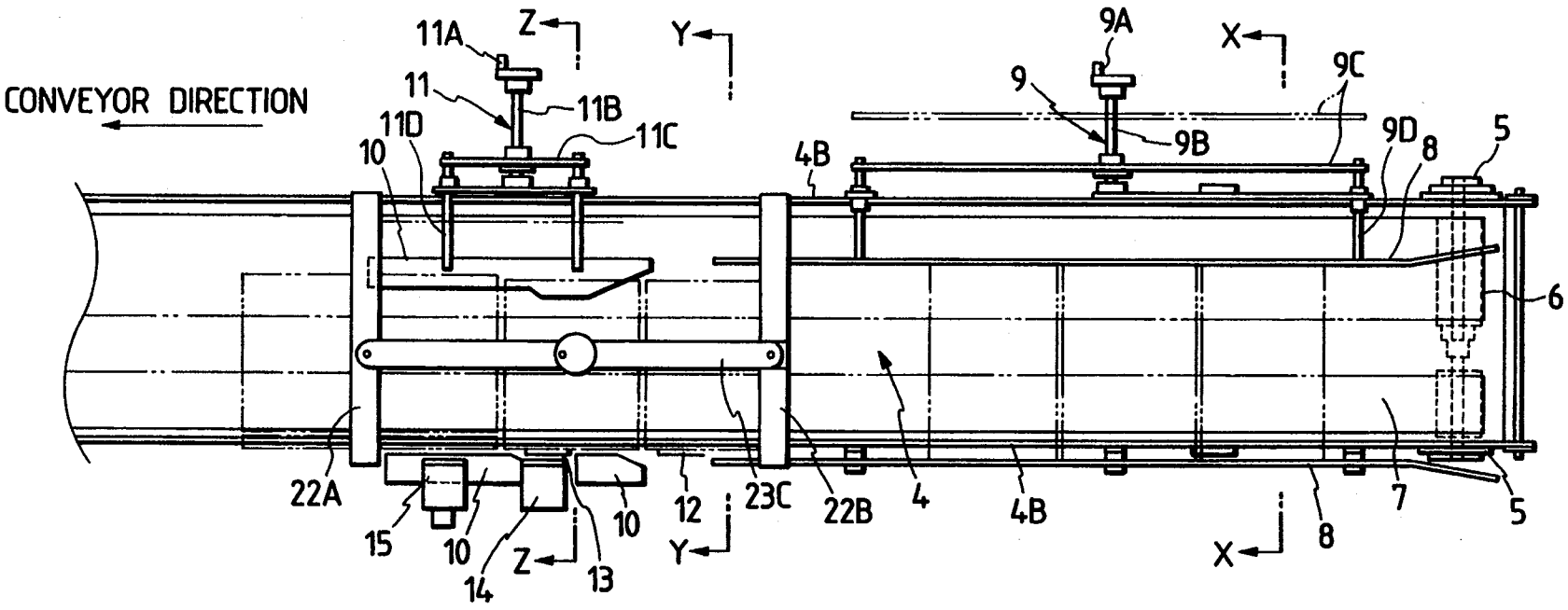
FIG. 6 is a plan view of the first embodiment of the lid opening device according to the invention.
Figure 9:
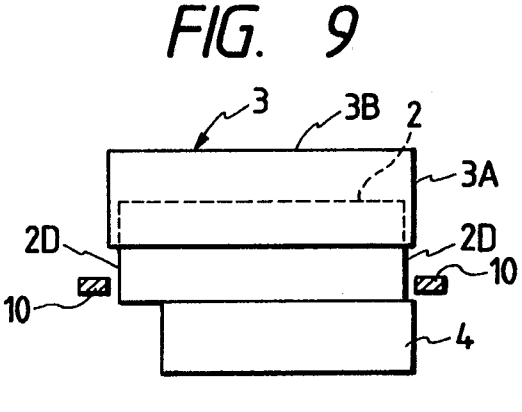
FIG. 9 is a section view taken along the line Z—Z in FIG. 6.
Figure 8:
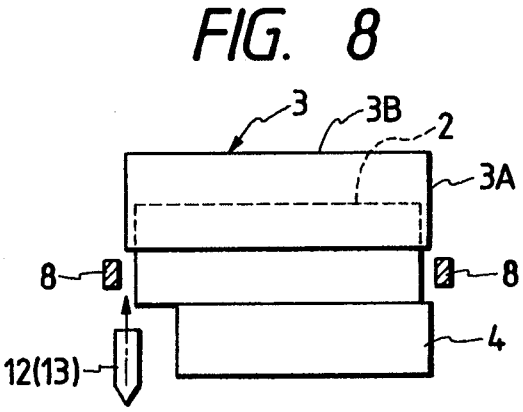
FIG. 8 is a section view taken along the line Y—Y in FIG. 6.
Figure 7:
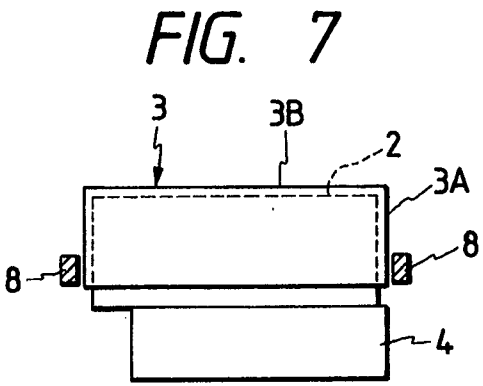
FIG. 7 is a section view taken along the line X—X in FIG. 6.

As shown in FIGS. 5 and 6, a belt conveyor 4 is supported by support legs 4A and includes a pair of frames 4B which are disposed in parallel to each other. To the respective one side ends of the pair of frames 4B, there are bearings 5 which are opposed to each other in the frame width direction.

A shaft having a tail pulley 6 fixed thereto is supported by the bearings 5 in such a manner that it extends between the bearings 5. A belt 7 is wound round and extends between the tail pulley 6 and a drive pulley (not shown) disposed on the opposite side thereof and supported on the frames 4B. On the belt 7, there are successively provided a plurality of boxes 1 in such a manner that the lids 3 of the boxes are respectively placed on the top of the boxes and the bottom surfaces 2C of the main bodies 2 are respectively put on the belt 7.

On both of the right and left sides of the belt conveyor 4, there are provided a pair of lid guides 8 in such a manner that they respectively extend a given distance in the longitudinal direction of the belt conveyor 4 and in parallel to the longitudinal direction of the belt conveyor 4. The lid guides 8, when the box 1 is loaded onto the belt conveyor 4, position the box 1 in the right and left direction thereof (that is, a direction perpendicular to the moving direction of the belt conveyor 4) on the outer side surfaces of the vertical portions 3A of the lid 3 so as to guide the movement of the box 1. The lid guide 8, which is disposed to the right with respect to the conveyance direction of the box 1, is connected to a guide width adjust device 9 fixed to the frame 4B. The guide width adjust device 9 is adapted such that, if a handle 9A is rotated, then the device 9 rotates a screw rod 9B, one end of which is rotatably supported on the frame 4B, to thereby move a support member 9C in the right and left direction (that is, a vertical direction in FIG. 6) so as to move the right lid guide 8, which is mounted through a pair of rods 9D integrally to the support member 9C, in the right and left direction. In this manner, the width of the right lid guide 8 can be adjusted according to the width of the box 1.

Also, on both sides of the belt conveyor 4, there are provided a pair of main body guides 10 which are respectively disposed downstream in the conveyance direction of the lid guides 8 and extend for a given distance and in parallel to the longitudinal direction of the belt conveyor 4. As will be described later, the main body guides 10, when the lid 3 of the box 1 is pushed upwardly, are used to position the right and left direction of the box 1 in the side surface portions 2D of the main body 2 and also to guide the movement of the box 1. The right main body guide 10 is connected to a guide width adjust device 11 which is fixed to the frame 4B. The guide width adjust device 11 is arranged such that, by operating a handle 11A, it rotates a screw rod 11B, one end of which is rotatably supported to the frame 4B, to move a support member 11C in a right and left direction (that is, in a vertical direction in FIG. 6), so as to move the right main body guide 10 in the right and left direction, which guide 10 is integrally mounted through a pair of rods 11D to the support member 11C.

Further, on both sides of the belt conveyor 4, substantially at the same positions of the main body guides 10, a first lower position injection nozzle 12 and a second lower position injection nozzle 13 which is located downstream of the first nozzle 12 are provided side by side in the conveyance direction. Downstream of the two lower position injection nozzles 12 and 13 and outside the second lower position injection nozzle 13, a first higher position injection nozzle 14 and a second higher position injection nozzle 15 which is located downstream of the first nozzle 14 are provided side by side along the conveyance direction.

Figure 10:
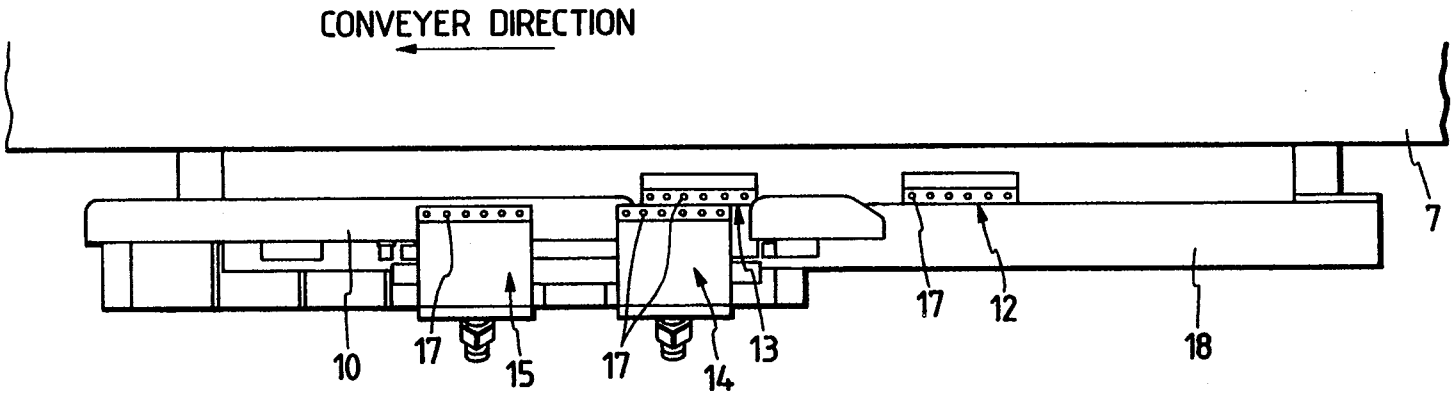
FIG. 10 is a plan view of main portions of the lid opening device according to the invention.
Figure 11:
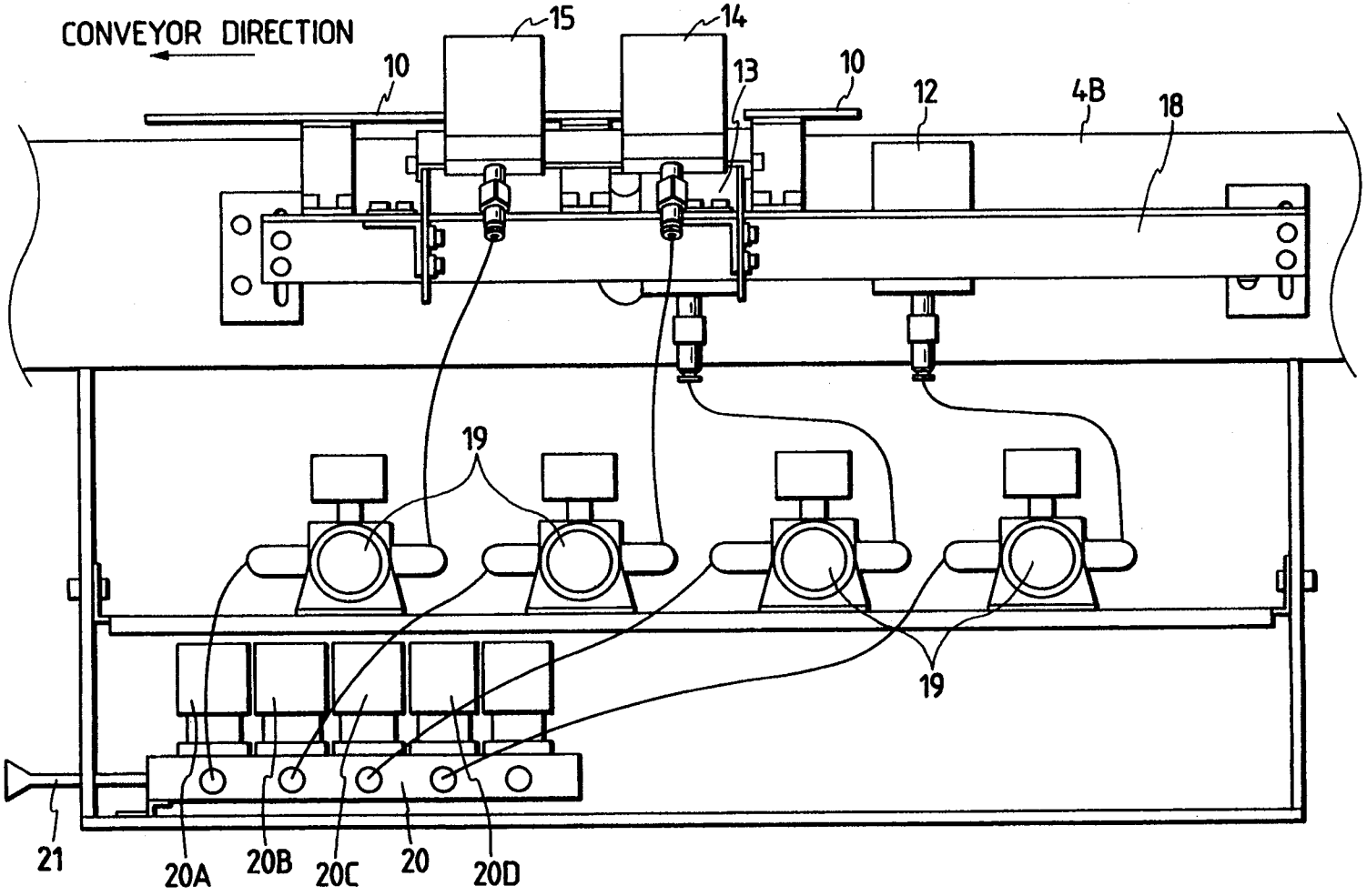
FIG. 11 is a side view of the main portions of the lid opening device according to the invention.
Figure 12:
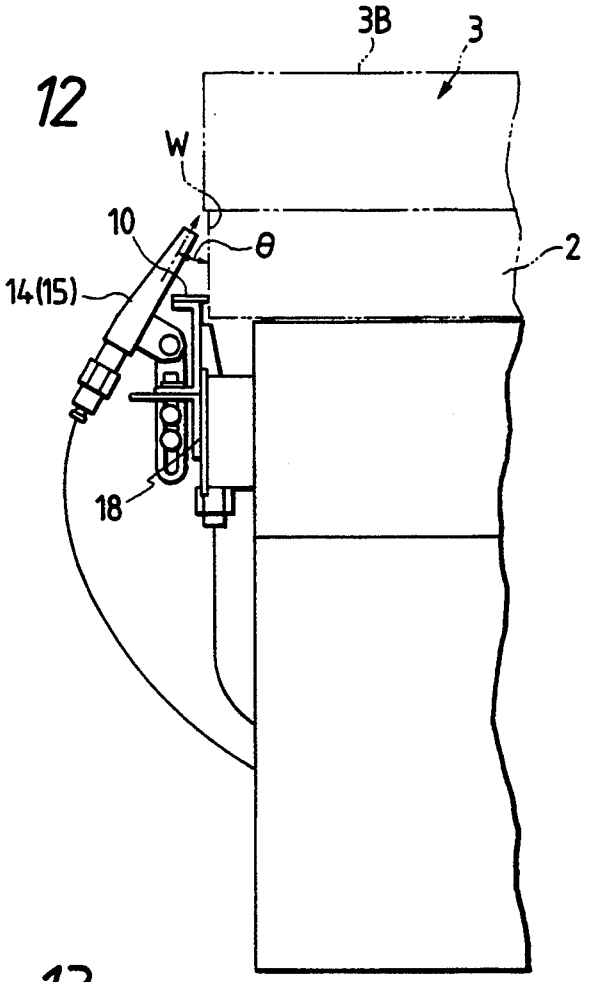
FIG. 12 is a front view of the main portions of the lid opening device according to the invention.
Figure 13:
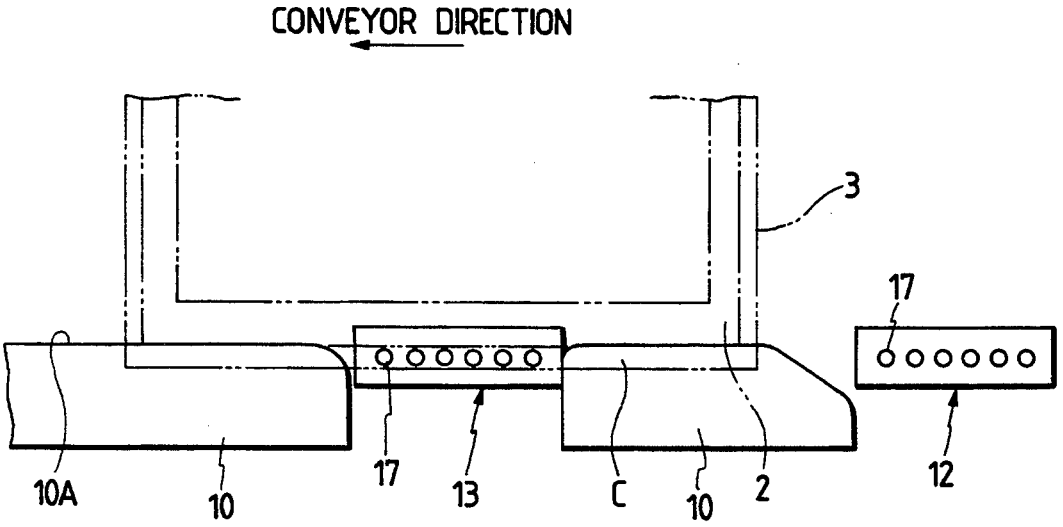
FIG. 13 is a plan view of the positional relation of the lower injection nozzle and the box.
Figure 14:
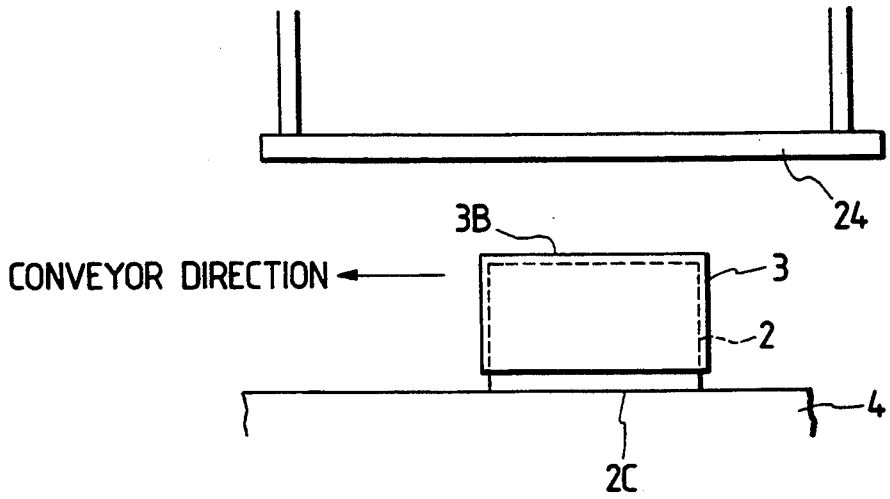
FIG. 14 is a front view of a lid rotating stopper employed in the embodiment shown in FIG. 5.

As shown in FIGS. 10, 12 and 13, each of the lower position injection nozzles 12, 13 and higher position injection nozzles 14, 15 has a plurality of injection ports 17 in a straight line extending along the conveyance direction of the box 1.

Figure 15:
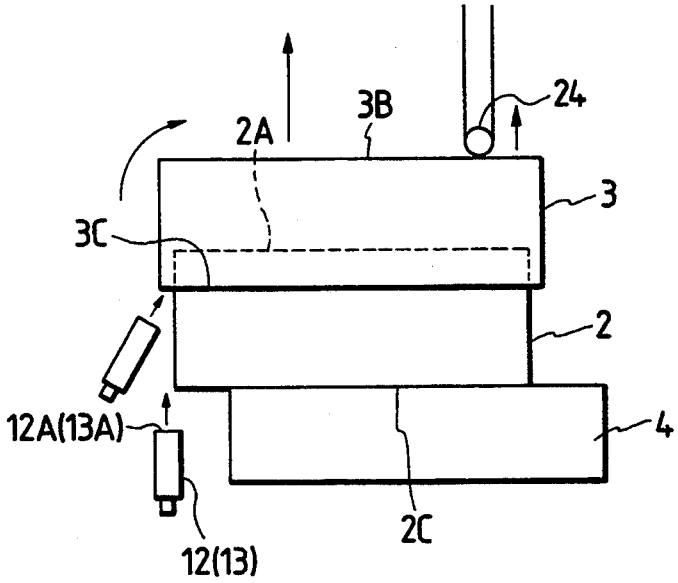
FIG. 15 is a side view of the lid rotating stopper and the box, illustrating a relationship between them.
Figure 16:
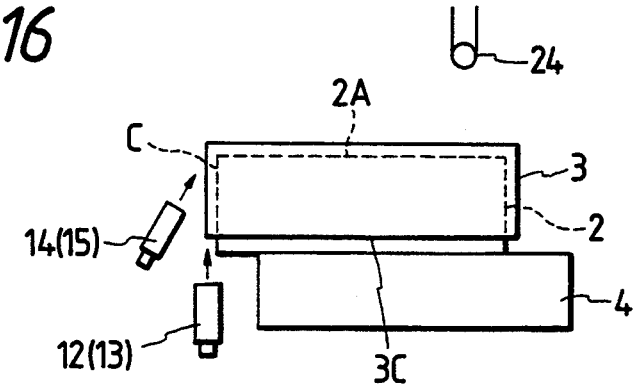
FIG. 16 is an explanatory view of the operation of the first embodiment.
Figure 17:
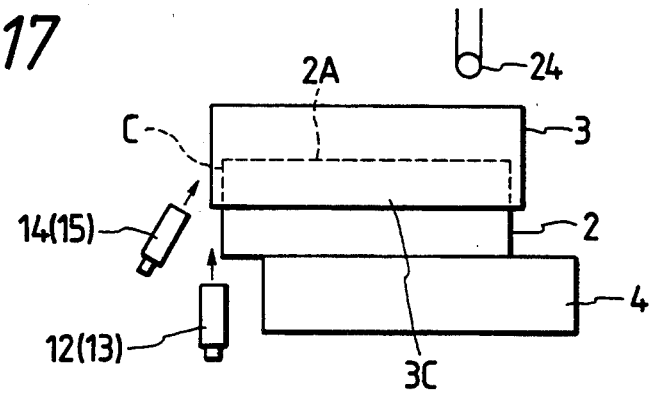
FIG. 17 is an explanatory view of the operation of the first embodiment.

The lower position injection nozzles 12 and 13 are disposed below the gap C. That is, the respective injection ports 17 of the above-mentioned lower position injection nozzles 12 and 13, as shown in FIG. 13, are situated outwardly of the guide surfaces 10A of the main body guides 10 and are disposed in a vertical attitude at positions overlapping the gap C of the box 1. And, as shown in FIG. 15, the leading ends 12A and 13A of the injection nozzles 12 and 13 are located slightly below the bottom surface 2C of the main body 2 and face upwardly.

The higher position injection nozzles 14 and 15 are mounted on a rail member 18 in such a manner that the injection angles, vertical positions and front and rear positions (in a direction perpendicular to the conveyance direction of the box 1) thereof can be adjusted, while the rail member 18 is mounted and fixed to the side surface of the frame 4B. According to such adjustment, the height positions of the higher position injection nozzles 14 and 15 can be set so that air can be injected from a gap between the lid 3 and a W surface (a side surface of the main body 2 on the side of the injection nozzle) at a proper angle $\theta$ with respect to the W surface and also, after the lid 3 is pushed up to some extent by the lower position injection nozzles 12 and 13, the air can be further injected from the gap between the lid 3 and W surface. Here, it should be noted that, when the lid 3 is not yet pushed up, the air is not allowed to enter the gap C.

The lower position injection nozzles 12 and 13 and the higher position injection nozzles 14 and 15 are connected respectively through regulators 19 to a manifold 20 which includes electro-magnetic valves 20A, 20B, 20C, 20D respectively adapted to control the operation timings of the above-mentioned injection nozzles 12, 13, 14, and 15. The manifold 20 is connected through a hose 21 to a source of compressed air such as compressor or the like.

On the other hand, as shown in FIGS. 5, 6, 14 and 15, in the belt conveyor 4, there is provided a stopper support device 22 in the neighborhood of the main body guides 10. The stopper support device 22 includes a pair of portal frames 22A and 22B respectively fixed and mounted to the frames 4B and also includes a height adjustment device 23 mounted to the portal frames 22A and 22B. A lid rotating stopper 24 is mounted on the height adjustment device 23. The lid rotating stopper 24 is formed of a rod member extending in the conveyance direction of the box 1. The stopper 24 is disposed spaced upwardly from the lid 3 of the box 1 and is also shifted in the opposite direction of the injection nozzles 12, 13, 14 and 15, so that the top plate 3B of the lid 3 can get contact with the lid rotating stopper 24. Therefore, the lid rotating stopper 24 is situated at a position to be able to give uniform pressure to the inside of the lid 3. For this reason, the lid 3 can be moved properly. That is, when the lid 3 is divided into two portions with a center of rotation thereof (namely, a point of contact with the top plate 3B of the lid 3) as the boundary, the portion of the lid 3 that has a larger area receiving air pressure, namely, the portion thereof on the nozzle side easily rises up, while the opposite portion thereof is easily falls down.

The height adjustment device 23 is arranged such that, by rotationally operating a handle 23A, it rotates a screw rod 23B rotatably supported on a bar 22C extended between the portal frames 22A and 22B to thereby move a support member 23C, so as to move vertically the lid rotating stopper 24 which is integrally mounted to the support member 23C through a pair of rods 23D.

Next, description will be given below of the operation of the above-mentioned embodiment of the invention.

On the belt 7 of the belt conveyor 4, there are successively put the boxes 1 each of which is in a state shown in FIG. 28, with the bottom surface 2C of the main body 2 resting on the belt 7. The boxes 1 are conveyed by driving the belt conveyor 4.

When the box 1 is conveyed to a position in the neighborhood of the lower position injection nozzles 12 and 13, air is injected uniformly from the respective injection ports 17 of the lower position injection nozzles 12 and 13 into the gap C between the inner side surface of the vertical portion 3A of the lid 3 of the box 1 and the outer side surface of the box main body 2. The uniform injection air pushes up the whole lid 3 gradually and averagely in the order of FIG. 16→FIG. 17→FIG. 18 to a height where the lower end opening 3C of the lid 3 is not separated from the upper end opening 2A of the main body 2.

Figure 18:
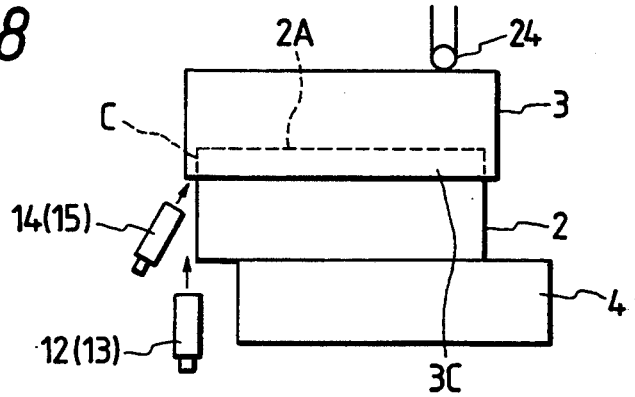
FIG. 18 is an explanatory view of the operation of the first embodiment.
Figure 19:
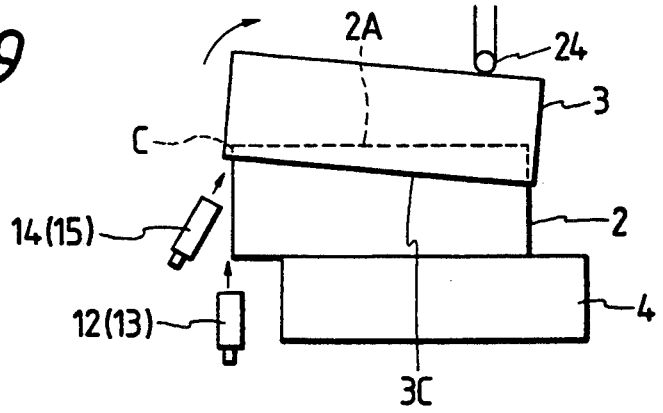
FIG. 19 is an explanatory view of the operation of the first embodiment.
Figure 20:
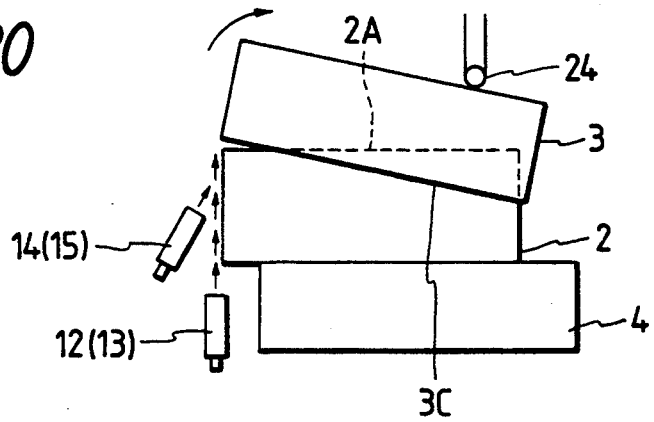
FIG. 20 is an explanatory view of the operation of the first embodiment.
Figure 21:
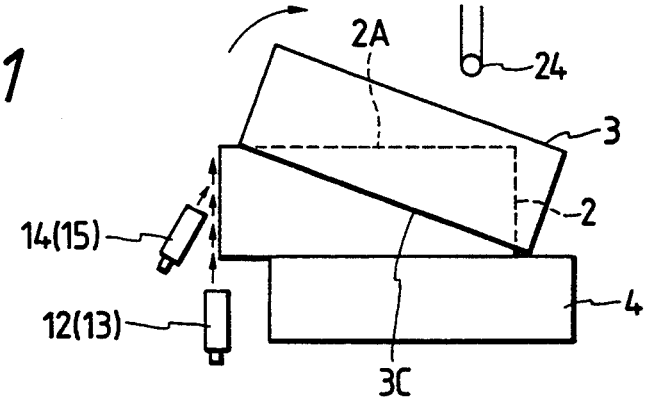
FIG. 21 is an explanatory view of the operation of the first embodiment.

When the box 1 is put into a state shown in FIG. 18, as shown in FIGS. 19, 20 and 21, the injection air of the higher position injection nozzles 14 and 15 reaches the gap C which is raised and the air is injected into the upper portion of the gap C by means of the higher position injection nozzles 14 and 15. The injection air moves the lid 3 in the order of FIG. 19→FIG. 20→FIG. 21 in such a manner that it raises one side of the lower end opening 3C of the lid 3 upwardly of the upper end opening 2A of the main body 2 while it lowers and inclines the opposite side of the lower end opening 3C, whereby the lid 3 can be opened from the main body 2 (the lid rotating stopper 24 also contributes to this operation, which will be described later).

Next, description will be given below in detail of an operation to open the lid 3 of the box 1. When air is injected into the box 1 from the gap C, with the vertical portions 3A of the lid 3 not raised, by means of the lower position injection nozzles 12 and 13, the internal pressure of the box 1 is increased higher than the external pressure thereof. The increased internal pressure produces a force from the inside of the box 1 to the lid 3 or main body 2, which force acts to open the lid 3 or main body 2. Here, the pressure of the air is set for the optimum pressure by means of the respective regulators 19. If the pressure of the air is too low, then the lid 3 cannot be pushed up and, if too high, then not only the lid 3 but also the main body 2 are pushed up at the same time, which fails to perform an expected operation to open the lid 3. In view of this, the optimum pressure of the air is determined according to a frictional force between the inner side surfaces of the vertical portions 3A of the lid 3 of the box 1 and the outer side surfaces of the main body 2, the materials of the lid 3 and main body 2, the weights thereof and the like. For example, the air pressure is set slightly greater than the frictional force between the inner side surfaces of the vertical portions 3A of the lid 3 of the box 1 and the outer side surfaces of the main body 2.

Then, due to the air injection by the lower position injection nozzles 12 and 13, one side of the lid 3 is raised up to a height where the lower end opening 3C of the lid 3 is not separated from the upper end opening 2A of the main body 2. However, as the one side of the lid 3 is raised up, the raising force by the lower position injection nozzles 12 and 13 is weakened so that gravity of the lid 3 is going to exceed the raising force and the lid will move downwardly. But, at a position where the lid 3 is raised in the above-mentioned manner, air is supplemented into the gap C between the raised lid 3 and main body 2 by the higher position injection nozzles 14 and 15. That is, the air injected by the higher position injection nozzles 14 and 15 raises further the one side of the lid 3 which is going to move down, thereby opening the lid 3 from the main body 2. As a result, the lid 3 is moved into an inclined state in which one side of the lower end opening 3C of the lid 3 is raised upwardly of the upper end opening 2A of the main body 2 while the other side thereof is lowered down.

While the lid 3 of the box 1 can be opened in the above-mentioned manner, opening of one side of the lid 3 is prevented by the action of the lid rotating stopper 24, which action will be described below.

At first, when the box 1 is conveyed to a given position, then the lid 3 is raised by the air, which is injected into the front portion of the gap C of the box 1 in the advancing direction thereof from the lower position injection nozzle 12, up to a height where the lower end opening 3C of the lid 3 is not separated from the upper end opening 2A of the main body 2. At that time, no air is injected yet to the rear portion of the gap C of the box 1 in the advancing direction thereof from the lower position injection nozzle 12, so that, when the lid 3 is viewed from the side surface thereof, the lid 3 is moved into an inclined state in such a manner that the front portion of the lid 3 in the advancing direction thereof is raised up and the rear portion thereof is lowered down.

When the box 1 is further conveyed and the front portion of the box 1 in the advancing direction thereof reaches the lower position injection nozzle 13 and higher position injection nozzle 14, then air is injected into the front portion of the gap C in the advancing direction thereof from the lower position injection nozzle 13 and air is injected into the rear portion of the gap C from the lower position injection nozzle 12, respectively, with the result that the lid 3 of the box 1 is raised up in an inclined state in a former step such that the advancing front portion thereof is raised higher than the advancing rear portion thereof.

In short, because a larger quantity of air is supplied to the advancing front portion of the gap C, the lid 3 is not opened in a direction perpendicular to the conveyance direction of the box, but is going to be opened in an inclined state of a three dimension in which corner of the lid 3 is pushed up, while part of the top plate 3B of the lid 3 is abutted against the lid rotating stopper 24. In this state, with the top plate 3B of the lid 3 pressed against the lid rotating stopper 24, if air is further injected into the gap C to thereby push up the portion of the top plate 3B of the lid 3 not in contact with the lid rotating stopper until it gets in contact with the lid rotating stopper 24, then the inclined attitude of the lid 3 is controlled to an inclined state of a two dimension so that the lid 3 can be opened from the main body 2.

In detail, the lid 3 is changed a state shown in FIG. 28 to a state shown in FIG. 29. In other words, the lid 3 runs onto the main body 2 in an inclined manner that one side of the lower end opening 3C of the lid 3 goes onto one side of the upper end opening 2A of the main body 2 and the other side of the lower end opening 3C of the lid 3 is supported on the belt 7, so that the lid 3 can be opened from the main body 2.

And, in a following step of packing, on the conveyor line, after the lid 3 is once separated completely from the main body 2, goods such as bottles or the like are packed automatically into the main body 2 and, after then, the lid 3 is put on the main body 2 automatically.

According to the above-mentioned structure, for example, when automatically opening the lids 3 of the boxes 1 from the main bodies 2 thereof, the boxes 1 being conveyed successively on the belt conveyor 4, each of the lids 3 is going to be opened in a state of three dimension inclination (one side opening), that is, in a state that the corner of the lid 3 is raised up. However, since part of the top plate 3B of the lid 3 is abutted against the lid rotating stopper 24, the portion of the top plate 3B of the lid 3 not in contact with the lid rotating stopper 24 is raised up until it is abutted against the lid rotating stopper 24, and then the lid 3 is opened from the main body 2. In this case, the opened state of the lid 3 can be controlled to a two-dimension inclination. Therefore, the one side opening of the lid 3 is prevented and the lids 3 opened are all in the same attitude. For example, even when the boxes 1 are conveyed successively with a narrow pitch, the lids 3 opened from the main bodies 3 do not collide with each other, but the opened states of the lids are stable. As a result of this, in a following step, the lid 3 can be separated from the main body 2 with ease to thereby eliminate the attitude correcting operation of the lid 3 by use of human hands.

If the lid 3 is opened only on one side thereof, then the air injected is not supplied into the box 1 but some of the air flows externally of the box 1, so that the internal pressure of the box 1 cannot be kept at a proper level and thus the lid 3 cannot be opened any further.

Also, although in the present embodiment description has been given of a case where the box 1 is being conveyed, the present invention can also apply to a case where the box 1 stands still. For example, even when the lid 3 of the box 1 is going to be opened from the main body 2 in a three dimension inclination state (one side opening state) due to the varied mountings of the lids 3 or due to the manufacturing errors of the boxes 1, a similar effect as in the above-mentioned case can be provided.

Further, according to the invention, air is injected into the box 1 from the gap C between the inner side surface of the vertical portion 3A of the lid 3 of the box 1 and the outer side surface of the main body 2 by means of the lower position injection nozzles 12, 13 and higher position injection nozzles 14, 15 disposed in two stages in a vertical direction to thereby secure the optimum air pressure for opening only the lid 3, before the lid 3 of the box 1 is opened from the main body 2. Due to this, the lid 3 and main body 2 of the box 1 are prevented from being pushed upwardly at the same time when the air is injected, and the opening of the lid 3 from the main body 2 in the box 1 can be ensured.

In the above-mentioned embodiment, although description has been given of a case where air is used as gas, this is not limitative but, for example, carbonic acid gas may be used.

Also, while in the embodiment the injection nozzles are arranged in two stages, they may be arranged in three or more stages.

Further, in the present embodiment, description has been given of a case where the lid 3 of the box 1 is opened from the main body 2 when the box 1 is being conveyed. However, the invention can be also apply to a case where the lid 3 is opened from the main body 2 by injecting air into the gap in two or more stages while the box 1 stands still. In this case, while in the present embodiment the lower position injection nozzles 12 and 13 and higher position injection nozzles 14 and 15 inject air at the same time, the lower position injection nozzles 12 and 13 initially may inject air and, at the same time when the air injection by the lower position injection nozzles 12 and 13 is stopped, the higher position injection nozzles 14 and 15 are allowed to inject air so as to be able to open the lid 3.

In the present embodiment, the higher position injection nozzles 14 and 15 are structured inclined but, according to the invention, the higher position injection nozzles 14 and 15 are not limited to this structure. For example, the higher injection nozzles 14 and 15 may be positioned at under the gap C which is caused by rising the lid 3 by the lower position injection nozzles 12 and 13 so that the respective injection ports of the higher position injection nozzles 14 and 15 is toward upwardly.

While in the present embodiment the lid rotating stopper 24 is adapted to cooperate with the lower position injection nozzles 12 and 13 and higher position injection nozzles 14 and 15, the lid rotating stopper 24 may also cooperate with at least one of the lower position injection nozzles 12 and 13 and higher position injection nozzles 14 and 15 to thereby be able to prevent the one side opening of the lid 3.

Also, in the present embodiment, the stopper support device 22 may include, in addition to the lid rotating stopper 24, another lid stopper which is situated nearer to the injection nozzles than the lid rotating stopper 24, so as to be able to prevent the lid 3 from being blown away onto the opposite side to the injection nozzles by air injected by the lower position injection nozzles 12 and 13 and higher position injection nozzles 14 and 15.

Figure 22:
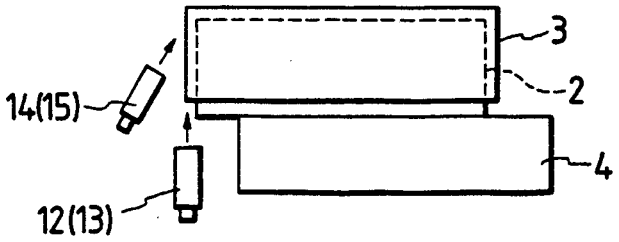
FIG. 22 is an explanatory view of the operation of a second embodiment according to the invention.
Figure 23:
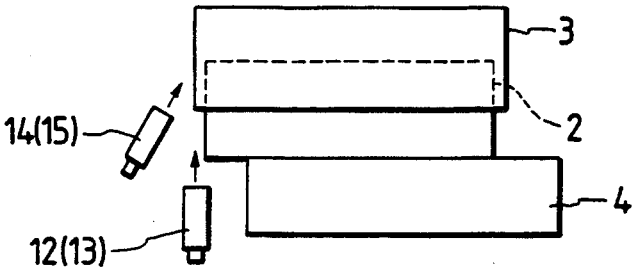
FIG. 23 is an explanatory view of the operation of the second embodiment.
Figure 24:
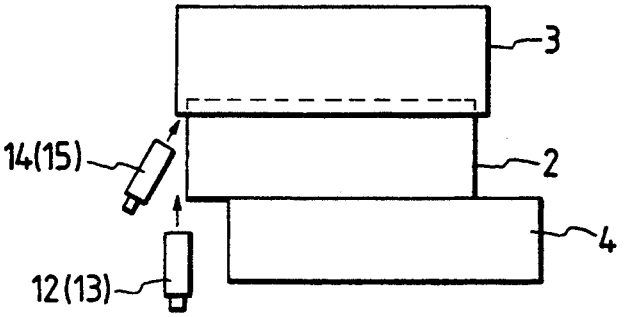
FIG. 24 is an explanatory view of the operation of the second embodiment.
Figure 25:
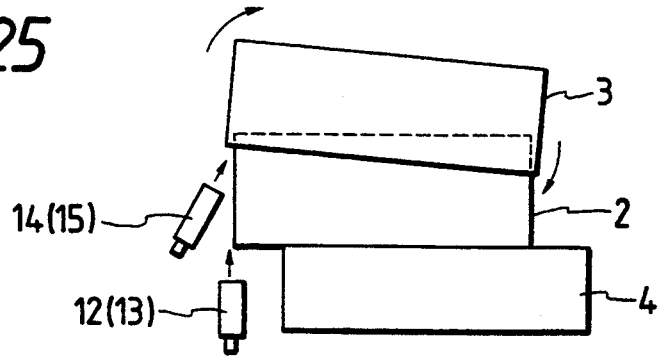
FIG. 25 is an explanatory view of the operation of the second embodiment.
Figure 26:
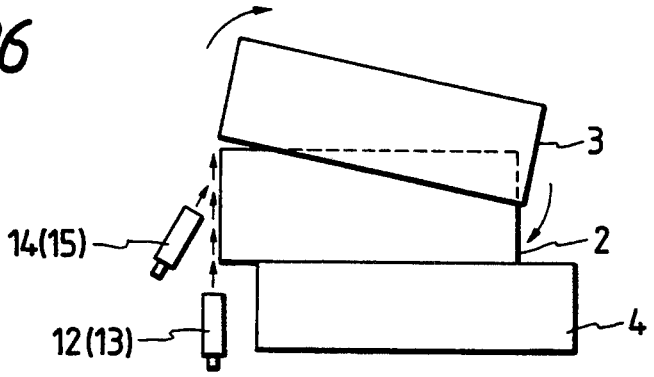
FIG. 26 is an explanatory view of the operation of the second embodiment.
Figure 27:
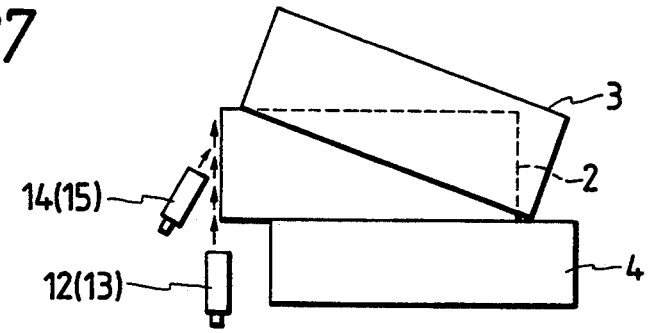
FIG. 27 is an explanatory view of the operation of the second embodiment.

Further, in the present embodiment, description has been given of the structure and operation thereof when it includes a lid rotating stopper. However, there is shown in FIGS. 22 to 27 a case where no lid rotating stopper is included. In FIG. 22, there is shown a state in which the lower position injection nozzles 12 and 13 and higher position injection nozzles 14 and 15 are disposed. At first, the lid 3 is pushed up in a manner of FIG. 22→FIG. 23 by air injected from the lower position injection nozzles 12 and 13 and, if the lid 3 is pushed up by a given height, then a state shown in FIG. 24 is obtained. If air is injected from the higher position injection nozzles 14 and 15, then the lid 3 is rotated in a manner of FIG. 24→FIG. 25→FIG. 26→FIG. 27, so that the lid 3 can be opened.

According to the second and third aspects of invention, for example, when opening a lid from each of boxes being conveyed successively, the lid is going to be opened with one corner thereof pushed up, that is, in a three-dimensional inclined state (in a one-side opened state) but, since part of a top plate of the lid is abutted against a lid rotating stopper, the portion of the top plate of the lid not in contact with the lid rotating stopper is pushed upwardly until the portion gets in contact with the lid rotating stopper and then the lid is opened from a main body of the box, so that the state of the lid opened can be a two-dimensional inclined state.

Therefore, the lids opened in this manner are all in the same attitude and thus, for example, even when the boxes are successively conveyed with a narrow pitch, the lids opened from the main bodies do not collide with one another, that is, the lids are opened in a stable manner. This allows, in a following step, the lids to be separated from the main bodies quite smoothly and easily, and also eliminates the need for an operation to correct the attitudes of the lids by human hands.

Also, even when the box lids are going to be opened from the box main bodies in a three-dimensional inclined state (in a one-side opened state) due to the varied mountings of the lids or due to the manufacturing errors of the boxes, the invention can provide a similar effect as in the above-mentioned case.

According to the fourth and fifth aspects of the invention, gas is injected into a box through a gap formed between the inner surface of the vertical portion of the lid of the box and the outer surface of the main body of the box by injection nozzles disposed in a plurality of stages in a vertical direction to thereby secure the optimum gas pressure to open only the lid of the box, before the lid is opened from the main body. This prevents the lid and main body of the box from being pushed upwardly simultaneously by the gas injected, and ensures that the lid of the box can be opened from the main body of the box.

What is claimed is:

1. A method of opening a lid from a freely openable and closable box constructed such that vertical portions of lid are superimposed on the peripheries of side surface portions of a main body of the box, said box having an opening formed in one portion thereof, wherein a gas is blown into said box from a gap formed between inner side surfaces of the vertical portions of said lid and outer side surfaces of said main body to thereby separate said main body and lid of said box from each other.

2. A method of opening a lid from a box which can be freely opened and closed and is constructed such that vertical portions of the lid are superimposed on peripheries of side surface portions of a main body of the box, said method comprising the steps of:

injecting gas, into a gap formed between an inner side surface of at least one of said vertical portions of said lid of said box and an outer side surface of said main body, with injection nozzle means disposed by a side of said main body to thereby push up said lid to a height at which a lower portion of said lid is not separated from an upper portion of said main body; and while part of a top plate of said lid is in contact with a lid rotating stopper disposed at a position spaced a given distance upwardly from said main body and in opposition to said injection nozzle means, further injecting said gas into said gap.

3. A method of opening a lid from a box which can be freely opened and closed and is constructed such that vertical portions of the lid are superimposed on peripheries of side surface portions of a main body of the box, said method comprising the steps of:

injecting gas into a gap formed between an inner side surface of at least one of said vertical portions of said lid of said box and an outer side surface of said main body by use of lower position injection nozzle means disposed by a side of said main body to thereby push up said lid to a height at which a lower portion of said lid is not separated from an upper portion of said main body; and injecting gas into said gap by use of higher position injection nozzle means disposed at a position higher than said lower position injection nozzle means to thereby open said lid from said main body.

4. An apparatus for opening a lid from a box which can be freely opened and closed and is constructed such that vertical portions of the lid are superimposed on peripheries of side surface portions of a main body of the box, said box being positioned on a support surface, said apparatus comprising:

injection nozzle means disposed beside a said support surface by a side of said main body for injecting gas into a gap formed between an inner side surface of at least one of said vertical portions of said lid of said box and an outer side surface of said main body; and a lid rotating stopper disposed at a position spaced a given distance upwardly from said support surface and in opposition to said injection nozzle means, said stopper being contacted by part of a top plate of said lid at a height where a lower portion of said lid is not separated from an upper portion of said main body.

5. An apparatus for opening a lid from a box which can be freely opened and closed and is constructed such that vertical portions of the lid are superimposed on peripheries of side surface portions of a main body of the box, said box being positioned on a support surface, said apparatus comprising:

lower position injection nozzle means disposed beside said support surface by a side of said main body for injecting gas into a gap formed between an inner side surface of at least one of said vertical portions of said lid of said box and an outer side surface of said main body to thereby push up said lid from said main body to a height where lower portion of said lid is not separated from an upper portion of said main body; and, higher position injection nozzle means disposed at a position higher than said lower position injection nozzle means for injecting gas into the gap to separate said lid from said main body.

6. An apparatus for opening a lid from a box as claimed in claim 5, further comprising a lid rotating stopper disposed at a position spaced a given distance upwardly from said support surface and in opposition to said injection nozzle means, said stopper being contacted by part of a top plate of said lid at a height where the lower portion of said lid is not separated from the upper portion of said main body.

7. An apparatus for opening a lid from a box as claimed in claim 5, wherein said higher position injection nozzle means comprise injection ports provided in a plurality of stages.

8. An apparatus for opening a lid from a box as claimed in claim 5, wherein said higher position injection nozzle means is inclined with respect to said side surface portion of said main body, and positioned to be able to inject said gas into a space which is caused by raising of said lid by said lower position injection nozzle means.

9. An apparatus for opening a lid from a box as claimed in claim 5, wherein said higher position injection nozzle means is positioned at under said space, respective injection ports of said higher position injection nozzle means are directed toward said space.

10. An apparatus for opening a lid from a box as claimed in claim 8, wherein said higher position injection nozzle means is adjustable in injection angle, vertical position and a position in a direction opposing to said side surface of said main body of said box.

11. An apparatus for opening a lid from a box which can be freely opened and closed and is constructed such that vertical portions of the lid are superimposed on peripheries of side surface portions of a main body of the box, said box being positioned on a support surface, said apparatus comprising:

conveyor means for conveying said box onto said support surface;

lower position injection nozzle means disposed beside said support surface by side of said main body for injecting gas into a gap formed between an inner side surface of at least one of said vertical portions of said lid of said box and an outer side surface of said main body to thereby push up said lid from said main body to a height where a lower portion of said lid is not separated from an upper portion of said main body;

higher position injection nozzle means disposed at a position higher than said lower position injecting nozzle means, and located downstream in said moving direction of said conveyor means for separating said lid from said box.

12. An apparatus for opening a lid from a box which can be freely opened and closed and is constructed such that vertical portions of the lid are superimposed on peripheries of side surface portions of a main body of the box, said box being on a support surface, said apparatus comprising:

conveyor means for conveying said box to said support surface;

lid guide means for guiding said lid in a direction perpendicular to a moving direction of said conveyor means;

main body guide means for guiding a main body of said box in a direction perpendicular to said moving direction of said conveyor means, said main body guide means being located downstream in the moving direction;

lower position injection nozzle means disposed beside said support surface by a side of said main body for injecting gas into a gap formed between an inner side surface of at least one of said vertical portions of said lid of said box and an outer side surface of said main body to lower portion of said lid is not separated from an upper portion of said main body;

higher position injection nozzle means disposed at a position higher than said lower position injection nozzle means for separating said lid from said main body; and a lid rotating stopper disposed at a position spaced a given distance upwardly from said support surface and in opposition to said injection nozzle means, said stopper being contacted by part of a top plate of said lid at a height where the lower portion of said lid is not separated from the upper portion of said main body.

13. An apparatus for opening a lid from a box as claimed in claim 12, wherein a width of said lid guide means is adjustable according to a width of said lid of said box by lid guide width adjustment means, and a width of said main body guide means is adjustable according to a width of said main body of said box by a main body guide width adjustment means.

14. An apparatus for opening a lid from a box as claimed in claim 12, wherein a height of said lid rotating stopper is adjustable in a vertical direction by a height adjustment means.

* * * * *